United States Patent [19]

Copas et al.

[11] Patent Number: 4,664,953

[45] Date of Patent: May 12, 1987

[54] COATING OF WIRE OR STRIP

[76] Inventors: Raymond J. Copas, 1 Second Street, Boolaroo; Dion F. Kentwell, 83 Gordon Avenue, Hamilton, both of Australia

[21] Appl. No.: 704,746

[22] Filed: Feb. 25, 1985

[30] Foreign Application Priority Data

Feb. 23, 1984 [AU] Australia ..... PG3753

[51] Int. Cl.[4] ..... B05D 1/18; B05D 3/12; B05C 3/02; B05C 11/02

[52] U.S. Cl. ..... 427/355; 118/103; 118/123; 118/405; 118/419; 427/367; 427/398.3; 427/434.6

[58] Field of Search ..... 427/355, 367, 369, 398.2, 427/398.3, 434.4, , 432, 433, 434.6; 118/103, 123, 125, 405, 419

[56] References Cited

U.S. PATENT DOCUMENTS

| | | | |
|---|---|---|---|
| 2,604,415 | 7/1952 | Whitfield et al. . | |
| 3,664,293 | 5/1972 | Hozumi et al. . | |
| 3,738,861 | 6/1973 | Sciffer et al. | 427/433 X |
| 3,892,894 | 7/1975 | Sciffer | 427/367 |
| 4,177,754 | 12/1979 | James et al. | 427/367 X |
| 4,207,362 | 6/1980 | Porter et al. | 427/434.4 X |
| 4,431,688 | 2/1984 | Kornmann . | |

FOREIGN PATENT DOCUMENTS

| | | |
|---|---|---|
| 418449 | 11/1971 | Australia . |
| 1387503 | 3/1975 | Australia . |
| 517173 | 3/1981 | Australia . |
| 517174 | 3/1981 | Australia . |
| 0032640 | 7/1981 | European Pat. Off. . |
| 1042417 | 9/1966 | United Kingdom . |
| 1116221 | 6/1968 | United Kingdom . |
| 1134724 | 11/1968 | United Kingdom . |
| 1422844 | 5/1972 | United Kingdom . |
| 1399974 | 7/1975 | United Kingdom . |
| 1440328 | 6/1976 | United Kingdom . |
| 1553109 | 9/1979 | United Kingdom . |

*Primary Examiner*—Michael R. Lusignan

*Attorney, Agent, or Firm*—Poms, Smith, Lande & Rose

[57] ABSTRACT

A method and apparatus for cooling metal wire or strip being drawn vertically from a hot dip bath and between a pair of refractory wiping pads. The wire or strip passing between the wiping pads directly into a chamber containing a cooling liquid which is supported above and at least in part by the wiping pads. The chamber having inlet and outlet means for the cooling liquid and a removable wall to allow more rapid draining of the chamber and access to the inside of the chamber for changing the wiping pads and/or re-threading the wire.

8 Claims, 2 Drawing Figures

FIG. 1
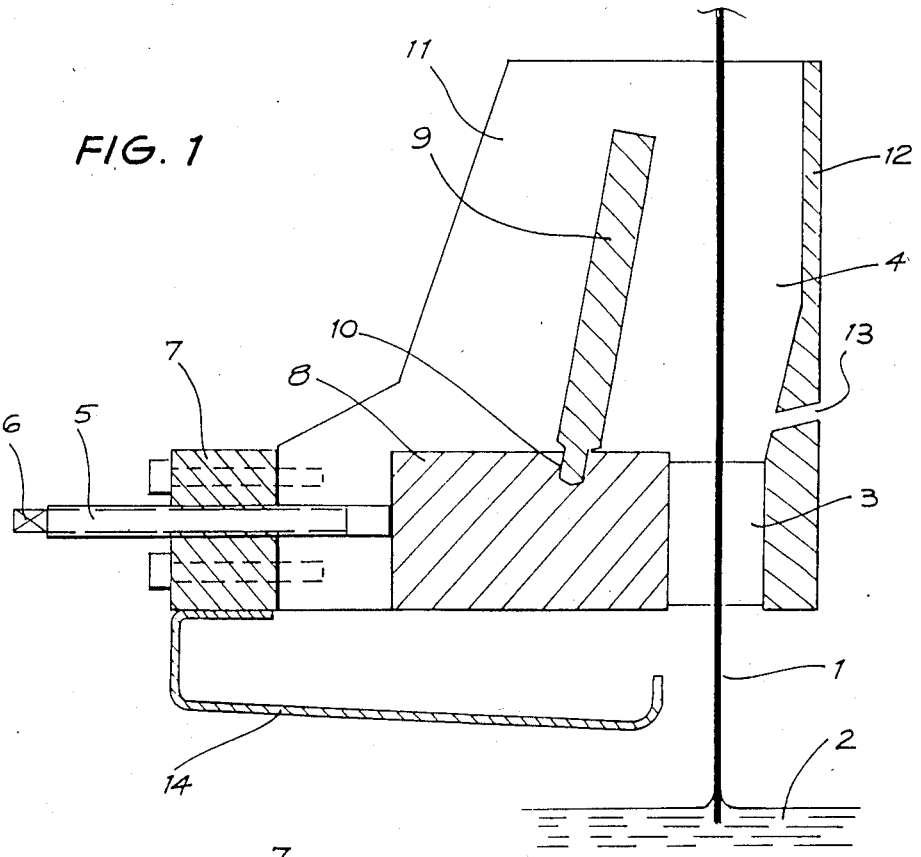
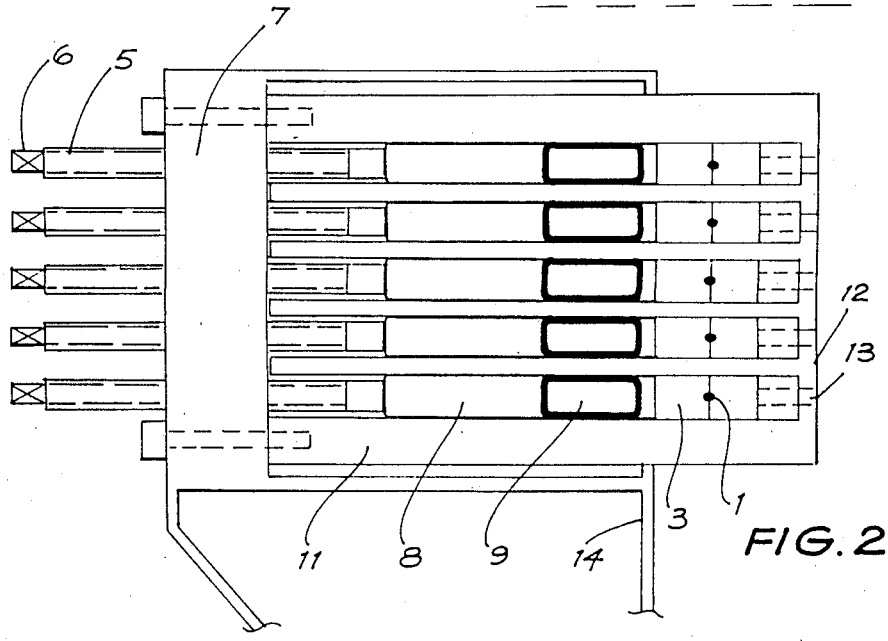
FIG. 2

COATING OF WIRE OR STRIP

The present invention relates to an apparatus and method for cooling a coating on a wire, strip or other continuous length of material (hereinafter called "wire") which has been subject to a hot dip or other coating process where cooling is required before the wire can be handled.

The corrosion resistance of wires and strip are often enhanced by the application of metallic coatings such as zinc, aluminium or their alloys by the hot dip process. The degree of protection required is related to the thickness of the coating. Where the corrosion conditions are not severe then only thin coatings are required such as those described in Australian Standard Specification AS1650 type B. The production of such coatings can be effected by withdrawing a wire or strip from a molten metal bath and wiping the surface of the coated wire with pads, blocks or like wiping members (hereinafter called "pads") made of a flexible, refractory material such as asbestos or alumino-silicate pads.

The configuration of the withdrawal operation may be such that the wire is withdrawn at a low angle to the molten metal bath surface, termed oblique withdrawal, or it may be vertical thereto. The oblique method is the most common technique in use as it is possible to handle the cooling water with a set of water jets and fixed weirs and produce smooth, bright coatings. However, this technique suffers from the disadvantage of limiting the access to the exit end of the molten metal bath. It is necessary for the operator to thread new wires and make adjustments from a platform mounted over the hot coated wires and cooling jets or operate awkwardly from the side of the bath. The difficulties are aggravated when heavily galvanised wire, produced by vertical withdrawal followed by gas wiping, is produced concurrently in the same bath as lightly coated, pad wiped, wire.

The production of coatings by wiping the excess molten metal off with pads bearing against the wires and held in suitable frames as the wires pass in a vertical direction is limited by the techniques available for providing and removing cooling water from a point in close proximity to the pads. Commercially satisfactory coated wire can be made by the use of separate cooling water jets or wheels but because of spatial restrictions they cannot be satisfactorily brought to bear close to the wiping pads and consequently very bright and uniform coatings are not achieved.

The use of tubes filled with water suffers from the disadvantage that wires cannot easily be threaded and the removal of cooling water after it has passed through the tube is cumbersome.

The present invention consists in an apparatus for wiping wire or strip passing upwardly from a bath of a liquid coating material, the apparatus comprising a pair of wiping pads, blocks or like wiping members between which the wire or strip is adapted to be passed from the bath of the liquid coating material, a chamber, having side walls and a base for cooling liquid extending upwardly from the wiping pads which constitute at least a part of the base of the chamber, inlet and outlet means to respectively introduce and remove the cooling liquid from the chamber, at least a part of one side wall of the chamber being separable from the base to allow drainage of the cooling liquid from the chamber.

The present invention further consists in a method for applying a thin coating to wire or strip, comprising passing the wire or strip upwardly from a bath of a liquid coating material, passing the wire or strip between a pair of wiping pads, blocks or like wiping members while biasing the wiping pads together, passing the wire or strip immediately through a chamber containing a cooling liquid supported above and, at least in part, by the wiping pads, and causing a stream of cooling liquid to pass continuously through the said chamber.

The present invention still further consists in a method for rethreading a wire or strip in apparatus for applying a coating to such wire or strip as defined above comprising the steps of:

(i) closing the inlet means to prevent the inflow of cooling liquid into the chamber;
(ii) separating or removing the said side wall from the base to discharge the cooling liquid in the chamber;
(iii) separating the wiping pads;
(iv) positioning the wire or strip through the liquid coating bath, between the wiping pads;
(v) biasing the wiping pads together about the wire or strip;
(vi) repositioning or replacing the side wall on the base; and
(vii) opening the inlet means to fill the chamber with cooling liquid.

The arrangement according to this invention allows efficient cooling immediately after the wire has been wiped which results in bright and uniform coatings. The arrangement according to this invention has the further advantage that it allows the apparatus to be so constructed that new wires may be readily threaded and replacement wiping pads may be readily inserted.

In preferred embodiments of this invention a number of wires may each be threaded through one of a plurality of chambers each containing a cooling liquid. Such an arrangement allows closer spacing of the wires than has hitherto been possible. A still further advantage of the arrangement according to this invention is that the whole apparatus, including the wiping pads, and chambers may be so formed that it is removable from above the liquid coating bath. This allows the bath to be readily converted to the use of other wiping systems such as gas wiping.

The invention has application principally in the application of a coating of zinc or aluminium or their alloys to metallic wires by the hot dip process. However it could be used in other processes such as the application of thin thermoplastic coatings to wires or other metal strips applied by the hot dip process.

The wiping pads are preferably formed of a hard wearing pad wiping material such as asbestos or an alumino-silicate material or of composition containing refractory fibres. The pad wiping material is preferably compressed into the desired form of the pad. The degree of compression and thus the further compressibility of the pad should be adjusted having regard to the diameter of the wire to be wiped. The pads need to be of sufficient compressibility that when the pads are urged closely against the wire they will deform sufficiently to apply an even wiping action around the full circumference of the wire. This compressibility of the pads is important both to ensure that the coating is applied evenly about the wire and also to prevent leakage of the cooling liquid from the chamber directly above the wiping pads down into the metal coating bath below the pads.

The wiping pads are preferably mounted in jaws which may be moved relatively towards and away from one another. The movement of the jaws is used to control the pressure of the pads on the wire and to allow periodic replacement of the pads once they have become worn. The movement of the jaws may be controlled by a screw driven ram or by an electrically or hydraulically driven ram. The force may be applied directly from the ram to the jaws or may be applied through springs.

The chamber containing the cooling liquid is formed with upstanding side walls and a base which comprises at least in part the wiping pads. At least one of the side walls is removable to allow rapid discharge of the cooling liquid from the chamber and facilitates the rethreading of a wire should that be necessary. It can be seen that the wire passing between the pads is drawn directly into the cooling container. This direct and immediate cooling of the wire allows minimal oxide formation on the coating and thus keeps the coating bright.

The container will have inlet and outlet means for the cooling liquid which is normally, and most preferably, water or an aqueous solution of passivating salts. The inlet preferably comprises a nozzle or jet directing the cooling liquid transversely to the direction of movement of the wire and preferably towards the wire as it emerges from between the pads. The incoming cooling liquid is most preferably directed such that it initially flows in a direction substantially in opposition to the direction of movement of the wire. After reaching the base of the container the cooling liquid preferably turns and flows upwardly in the same direction as the wire . The outlet means may be an aperture through which the cooling liquid flows or a weir over which it flows. The aperture to discharge the cooling liquid may be located in either the removable wall or in the fixed walls. In another embodiment pump means may be used to remove cooling liquid from the chamber.

The chamber includes a removable weir, the removal of which allows the chamber to be rapidly drained. It is obviously desirable that large volumes of water or other cooling liquid not be allowed to run into a hot coating bath when a wire is to be rethreaded or a pad replaced. The provision of one wall of the container which is removable allows rapid but controlled discharge of the water or other cooling liquid into a collection tray or channel. In a particularly preferred embodiment of the invention the upper edge of the removable wall constitutes a weir acting as the outlet means such that all cooling liquid discharged from the chamber is directed through the same drainage system.

Cooling liquid which has passed through the container may be discharged to waste or may be collected, cooled and recycled if that is more economic.

The use of the removable wall acting as a weir gives easier access to the wiping point where the pads are located. In addition because the cooling chamber does not continuously encircle the wire permanently then it is possible to remove or replace a continuous length of wire from or into the apparatus without severing the wire. After the removable wall is removed and the movable block used to urge the pads is withdrawn from the guides then full access to the apparatus is afforded.

Hereinafter given by way of example only is a preferred embodiment of the present invention described with reference to the accompanying drawings in which:

FIG. 1 is a diagrammatic vertical sectional view along the longitudinal axis of an apparatus according to the present invention, and FIG. 2 is a plan view of the apparatus of FIG. 1.

A wire 1, is drawn upwardly in a substantially vertical direction from the molten metal bath 2, between resilient refractory pads 3 and then upwardly directly into the cooling chamber 4. The wire proceeds upwardly through the cooling chamber to reduce the temperature of the wire below the melting point of the coating.

To effect a wiping action with the pads 3, the threaded shaft 5, is caused to rotate by means of a lever or wheel applied to a boss 6, which in turn drives the shaft forward through the threaded fixed block 7. Force is exerted on the pads 3, through sliding block 8. Block 8 is constrained from moving vertically by lateral guides (not shown).

The cooling chamber includes a removable wall 9 consituting a weir. The wall 9 is removable without disassembling the entire apparatus. The wall 9 is held at its lower extremity either by locating it in a recess 10, in block 8, or by pinning it between block 8 and pads 3. The wall 9 can be made from a non-resilient material which is accurately formed to fit between the opening formed between the sidewalls 11.

Alternatively the wall 9 can be made from expandable material or a composite and this be held by friction against the sidewalls, 11, after insertion. It would be positioned so that the lower extremity butts against block 8 to form the cavity of the cooling chamber. The cooling chamber is formed by the removable wall 9, fixed sidewalls 11, and rear wall 12. The chamber is sealed at the base by the block 8, and pads 3. Cooling water or solution enters via inlet 13, in a generally downwardly direction, turns at the bottom of the chamber and flows upwardly to discharge over the removable wall 9. The discharged water flows down the face of the wall 9, over block 8, and falls into a collection tray 14, from where it is directed to a drain or recirculation system.

We claim:

1. Apparatus for wiping wire or strip passing upwardly from a bath of a liquid coating material, the apparatus comprising a pair of wiping pads, blocks or like wiping members between which the wire or strip is adapted to be passed from the bath of the liquid coating material, a chamber, having side walls and a base for cooling liquid extending upwardly from the wiping pads which constitute at least a part of the base of the chamber, inlet and outlet means to respectively introduce and remove the cooling liquid from the chamber, at least a part of one side wall of the chamber being separable from the base to allow drainage of the cooling liquid from the chamber.

2. Apparatus as claimed in claim 1 in which at least part of the said one side wall is removable from the chamber.

3. Apparatus as claimed in claim 2 in which the removable side wall is made of a rigid material and is held in position at its lower extremity by connection with a movable block employed to urge the wiping pads into close contact with the wire or strip.

4. Apparatus as claimed in claim 2 in which the removable wall is made of a resilient material and is held in position by frictional engagement against the non-removable walls of the chamber.

5. Apparatus as claimed in claim 1 in which the upper edge of the removable wall acts as a weir which constitutes the outlet means for the cooling liquid.

6. Apparatus as claimed in claim 5 in which the height of the upper edge of the removable wall above the wiping pads is adjustable to allow adjustment of the height of the cooling liquid in the chamber.

7. Apparatus as claimed in claim 1 in which cooling liquid discharge means are provided to receive and conduct away from the apparatus cooling liquid discharged from the chamber through the outlet means and cooling liquid discharged from the chamber by the separation or removal of the said side wall from the base.

8. A method for rethreading a wire or strip into an apparatus for coating said wire or strip of the type wherein said wire or strip passes upwardly from a bath of liquid coating material, through a pair of wiping members, and thence through a chamber containing a cooling liquid, to exit said chamber in a substantially vertical direction, said chamber having inlet means for introducing said cooling liquid into said chamber, and wherein at least one of said wiping members constitutes a base portion and removable side wall portion of said chamber, comprising the steps of:

(i) closing said inlet means to prevent inflow of said cooling liquid into said chamber;

(ii) removing or separating said removable side wall portion of said chamber from said base portion to discharge said cooling liquid from said chamber;

(iii) separating said pair of wiping members;

(iv) positioning said wire or strip through said liquid coating bath and between said wiping members;

(v) biasing said wiping members together about said wire or strip;

(vi) replacing or repositioning said removed side wall portion of said chamber on said base portion; and (vii) opening said inlet means to fill said chamber with said cooling liquid.

* * * * *